US011059630B2

(12) United States Patent
Difalco et al.

(10) Patent No.: US 11,059,630 B2
(45) Date of Patent: Jul. 13, 2021

(54) SYSTEMS AND METHODS FOR ALERTING UNAUTHORIZED ACCESS INTO A CONTAINER

(71) Applicant: CEROVENE, INC., Valley Cottage, NY (US)

(72) Inventors: Raymond J. Difalco, Ridgewood, NJ (US); Manish S. Shah, West Caldwell, NJ (US)

(73) Assignee: Cerovene Pharma, LLC, Valley Cottage, NY (US)

( * ) Notice: Subject to any disclaimer, the term of this patent is extended or adjusted under 35 U.S.C. 154(b) by 0 days.

(21) Appl. No.: 15/556,539

(22) PCT Filed: Jun. 3, 2016

(86) PCT No.: PCT/US2016/035793
§ 371 (c)(1),
(2) Date: Sep. 7, 2017

(87) PCT Pub. No.: WO2016/196977
PCT Pub. Date: Dec. 8, 2016

(65) Prior Publication Data

US 2018/0082553 A1 Mar. 22, 2018

Related U.S. Application Data

(60) Provisional application No. 62/170,592, filed on Jun. 3, 2015.

(51) Int. Cl.
*B65D 43/02* (2006.01)
*B65D 43/26* (2006.01)
(Continued)

(52) U.S. Cl.
CPC ..... *B65D 43/26* (2013.01); *B65D 43/02* (2013.01); *B65D 55/02* (2013.01); *B65D 1/02* (2013.01);
(Continued)

(58) Field of Classification Search
CPC .... A61J 7/00; A61J 7/0084; A61J 7/04; A61J 7/0409; A61J 7/0436; A61J 7/0481; A61J 7/0076; A61J 7/0472; G06F 19/00; G06F 19/3418; G06F 19/3456; G06F 19/3462; G08B 21/18; G08B 21/24; G08B 18/245; B65D 5/06; B65D 53/00; B65D 43/02; B65D 43/26; B65D 47/06; B65D 51/24
See application file for complete search history.

(56) References Cited

U.S. PATENT DOCUMENTS 7,715,277 B2 * 5/2010 de la Huerga ..... A61J 7/0084 221/2
8,391,104 B2 * 3/2013 de la Huerga ..... A61J 1/035 206/459.5
(Continued)

OTHER PUBLICATIONS

International Search Report issued in International application No. PCT/US2016/035793, dated Sep. 16, 2016.

*Primary Examiner* — Van T Trieu
(74) *Attorney, Agent, or Firm* — IP Pundit LLC

(57) ABSTRACT

The present disclosure provides devices, systems and methods for monitoring unauthorized access into a container or bottle, and alerting the authorized user, or someone designated by the authorized user, of any unauthorized access.

4 Claims, 5 Drawing Sheets

(51) Int. Cl.

| | |
|---|---|
| ***B65D 55/02*** | (2006.01) |
| *G08B 13/08* | (2006.01) |
| *G08B 13/14* | (2006.01) |
| *B65D 1/02* | (2006.01) |
| *B65D 41/00* | (2006.01) |

(52) U.S. Cl.
CPC ..... *B65D 41/00* (2013.01); *G08B 13/08* (2013.01); *G08B 13/14* (2013.01)

(56) References Cited

U.S. PATENT DOCUMENTS

| | | | | |
|---|---|---|---|---|
| 8,963,710 | B2 * | 2/2015 | Huang | A61J 1/03 340/540 |
| 9,014,427 | B2 * | 4/2015 | Bear | A61J 7/0076 348/135 |
| 9,361,772 | B2 * | 6/2016 | Johnson | G08B 21/24 |
| 2005/0151625 | A1 * | 7/2005 | Lai | G08B 21/24 340/309.16 |
| 2006/0218011 | A1 * | 9/2006 | Walker | G16H 40/60 705/3 |
| 2009/0294521 | A1 * | 12/2009 | de la Huerga | A61J 1/035 235/375 |
| 2011/0012742 | A1 | 1/2011 | Johnson | |
| 2011/0226817 | A1 * | 9/2011 | Ortenzi | A61J 1/1425 222/424.5 |
| 2011/0227734 | A1 | 9/2011 | Ortenzi et al. | |
| 2013/0320020 | A1 * | 12/2013 | Elliott | A61J 1/035 220/378 |
| 2014/0278510 | A1 | 9/2014 | McLean et al. | |
| 2015/0272825 | A1 * | 10/2015 | Lim | A61J 1/03 340/5.2 |

* cited by examiner

SYSTEMS AND METHODS FOR ALERTING UNAUTHORIZED ACCESS INTO A CONTAINER

CLAIM OF PRIORITY

The present Application for Patent claims priority to Provisional Application No. 62/170,592 entitled "SYSTEMS AND METHODS FOR ALERTING UNAUTHORIZED ACCESS INTO A CONTAINER" filed Jun. 3, 2015, which is hereby expressly incorporated by reference.

BACKGROUND

Aspects of the present disclosure generally relate to providing an authorized user with an alert in connection with the access of a container or bottle.

In many instances, issues may arise when an unauthorized access into the contents or substances stored in a container or bottle occurs, particularly when such contents or substances can be hazardous or are intended to have restricted usage. For example, at least for safety reasons, access is generally restricted to contents or substances such as ammunition for weapons, chemical cleaners found in a home, or pharmaceutical dosage forms prescribed to a patient. As such, it is desirable to implement devices, systems, and methods that allow for the monitoring or verification of access into a container or bottle to determine whether the access is performed by an authorized user and/or in the intended manner.

SUMMARY

The present disclosure provides devices, systems and methods for monitoring unauthorized access into a container or bottle, and alerting the authorized user, or someone designated by the authorized user, of any unauthorized access. The present disclosure also provides systems and methods of monitoring movement, motion, or displacement of a container or bottle, and alerting the authorized user, or someone designated by the authorized user of the movement, motion, or displacement. The present disclosure also provides devices, systems and methods of notifying the owner or authorized user when the bottle cap or container lid is removed or opened. The present disclosure also provides devices, systems and methods of providing an indicator light when a container or bottle is opened and the indicator light may remain illuminated for a pre-determined period of time (e.g., 24 hours) or when the bottle is re-opened by an authorized user. The present disclosure also provides for a container bottle or a container cap, or a container comprising a container bottle and container cap.

In an aspect, a container for storing one or more objects, such as, for example, ammunition for weapons, chemical cleaners found in a home, or pharmaceutical dosage forms prescribed to an authorized user, may include an identification device configured to receive an identifier of a user attempting to access to the one or more objects or substances stored in the container or bottle. In one aspect, the container may alternatively or additionally include a motion detection device which is configured to detect the position of the container or detect a change in the position of the container. The container may further include a processing device that signals an indicator light when the bottle is opened and remains illuminated for a pre-determined period of time (e.g., 24 hours) or when the bottle is re-opened by a authorized user to notify or otherwise indicate to the authorized user that the bottle has been opened. The container may further include a processing device in communication with the identification device and/or motion detection device. The container may further include a processing device in communication with the identification device to notify the owner or authorized user of the bottle that the cap of the bottle was removed (or at least partially removed). In one aspect, the processing device may be configured to compare the identifier of the user attempting access to an identifier of the authorized user. In one aspect, the processing device may be configured to determine if motion or movement of the container has occurred. Additionally, the container may include one or more of a transmitter, a sounding device, or an indicator light or illumination device, which may be in communication with the processing device and which may be used to signal or indicate cap or lid removal to an authorized user. The transmitter may be configured to transmit an alert to a remote device when the identifier of the user attempting to access the contents of the container or bottle does not match the identifier of the authorized user and/or when the container is moved from a stationary position or when the cap is removed or opened from the bottle. The sounding device may be configured to generate a sounding alarm when the identifier of the user attempting access does not match the identifier of the authorized user and/or when the container is moved from a stationary position.

In one aspect, a method of detecting and alerting to unauthorized access into a container includes receiving an identifier of a user attempting access into the container. The method further includes determining, via a processing device, that the identifier of the user attempting access does not match an identifier of an authorized user. In addition, the method includes sending an alert or message to a remote device associated with the authorized user and/or generating a sounding alarm when the identifier of the user attempting access does not match the identifier of the authorized user. In addition, the method includes sending an alert or message to a remote device associated with the authorized user when the bottle cap is removed from the bottle.

In one aspect, a method of detecting and alerting to motion or movement of the container includes receiving an indication that the container has been moved from a stationary position. In addition, the method provides sending an alert or message to a remote device associated with the authorized user and/or generating a sounding alarm when the identifier of the user attempting access does not match the identifier of the authorized user. In addition, the method includes sending an alert or message to a remote device associated with the authorized user when the bottle cap is removed from the bottle. The container may further include a processing device that signals an indicator light when the bottle is open and remains illuminated for 24 hrs or when the bottle is re-open by a authorized user to notify the authorized user the bottle has been open.

When the container contains pharmaceutical dosage forms, methods and systems in accordance with aspects of the present disclosure may be used, for example, for assisting physicians, medical personnel, and/or patients in detecting and identifying unauthorized use of the pharmaceutical dosage forms via unauthorized access into the container. For example, methods and systems in accordance with aspects of the present disclosure may be useful for health care workers to insure that medication is taken safely and as prescribed by elderly patients, patients who are cognitively compromised, or any other patient that needs to be monitored In addition, methods and systems in accordance with the present disclosure may be useful to monitor unintended or unauthorized access by children.

When the container contains ammunition for different calibers forms, devices, methods and systems in accordance with aspects of the present disclosure may be used to, for example, assist legal agencies or similar entities in detecting and identifying unauthorized use of weapon ammunition via unauthorized access into the storage container.

In another aspect, a container or bottle for storing one or more substances prescribed to or procured by an authorized user, including a motion detection device configured to detect movement or displacement of the container or bottle, an opening trigger detection device configured to detect when a lid or cap is at least partially removed from the container or bottle, and a transmitter in communication with the motion detection device and the opening trigger detection device. The transmitter may be configured to transmit an alert to one or both of a remote device or an alert system via a network in response to one or both of the motion detection device detecting a movement or displacement of the container or bottle, or the opening trigger detection device detecting the lid or cap being at least partially removed from the container or bottle. In yet another aspect, the lid or cap may be removably attached part of the container or bottle, and one or more of the motion detection device, the opening trigger detection device, or the transmitter are positioned in the lid or cap.

In yet another aspect, the container or bottle may further include an identification device configured to receive an identifier of a user attempting to access the one or more substances stored in the container or bottle, and a processing device in communication with the identification device, the processing device being configured to determine whether the identifier of the user attempting to access the one or more substances stored in the container or bottle matches an identifier of the authorized user. The transmitter may be in communication with the motion detection device, the opening trigger detection device, and the processing device, and the transmitter may be configured to transmit the alert to one or both of the remote device or the alert system via the network in response to one or more of the motion detection device detecting a movement or displacement of the container or bottle, the opening trigger detection device detecting the lid or cap being at least partially removed from the container or bottle, or the processing device determining that the identifier of the user attempting to access the one or more substances stored in the container or bottle does not match the identifier of the authorized user.

In another aspect, a lid or cap configured to be removably attached to a container or bottle that stores one or more substances prescribed to or procured by an authorized user may include a motion detection device configured to detect movement or displacement of the lid or cap when attached to the container or bottle, an opening trigger detection device configured to detect when a lid or cap is at least partially removed from the container or bottle, and a transmitter in communication with the motion detection device and the opening trigger detection device. The transmitter may be configured to transmit an alert to one or both of a remote device or an alert system via a network in response to one or both of the motion detection device detecting a movement or displacement of the lid or cap when attached to the container or bottle, or the opening trigger detection device detecting the lid or cap being at least partially removed from the container or bottle.

Additional advantages and novel features in accordance with aspects of the present disclosure will be set forth in part in the description that follows, and in part will become more apparent to those skilled in the art upon examination of the following or upon learning by practice thereof.

BRIEF DESCRIPTION OF THE FIGURES

The features, nature, and advantages of the present disclosure will become more apparent from the detailed description set forth below when taken in conjunction with the drawings in which like reference characters identify correspondingly throughout and wherein.

DETAILED DESCRIPTION

Figure 1:
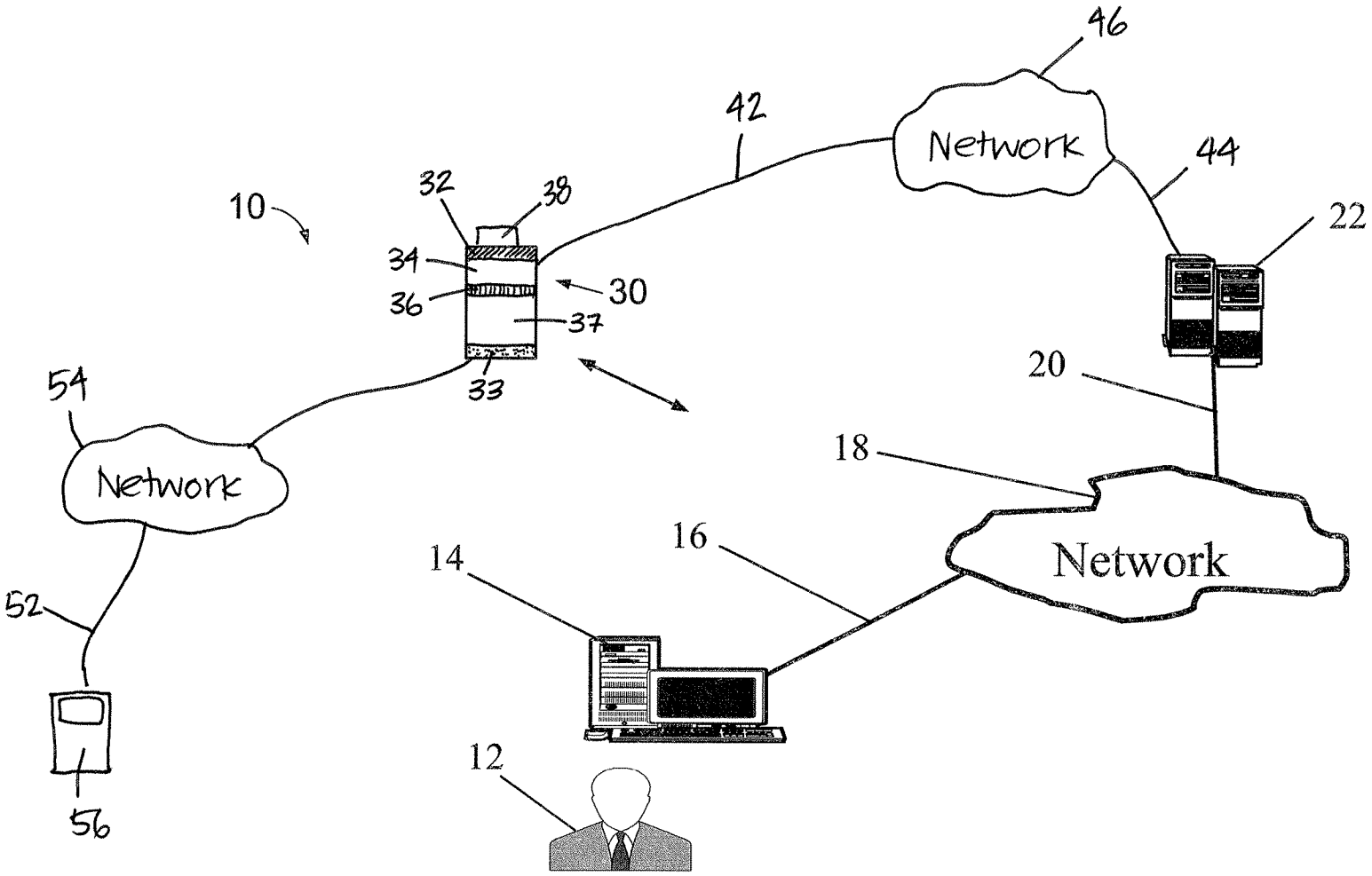
FIG. 1 is an example schematic diagram of a communication system in accordance with an aspect of the present disclosure.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

The present disclosure generally relates to devices, systems and methods for detecting and alerting to unauthorized access into a container and/or detecting and alerting to movement of a container. In preferred implementations, the present disclosure may be used to detect and alert to access, especially unauthorized access, to one or more objects or substances, such as ammunition for weapons, chemical cleaners found in a home, as well pharmaceutical dosage forms, that may be contained or stored in the container. Additionally, the present aspects relate to alerting at least one authorized user of an access or an attempted access into the container by an unauthorized user. In preferred implementations, the one or more objects contained or stored in the container may include one or more ammunition for weapons, chemical cleaners found in a home and pharmaceutical dosage forms. In such implementations, a patient or customer may obtain a container containing one or more ammunition for weapons, chemical cleaners found in a home or pharmaceutical dosage forms from a gun shop, grocery store or pharmacy. In some aspects, the one or more ammunition for weapons, chemical cleaners found in a home or pharmaceutical dosage forms may comprise controlled drug substances or other drugs that may be subject to abuse by an unauthorized user as well as ammunition for weapons and chemical cleaners found in a home. The patient receiving the prescribed medication or a customer purchasing or procuring ammunition for weapons, chemical cleaners found in a home may be considered or alternatively referred to as an "authorized user". In some embodiments, the "authorized user" may include one or more persons purchasing weapons or dangerous household cleaners designated by their own self use or a pharmaceutical product the doctor prescribing or the patient receiving the prescribed medication, including but not limited to family members or caretakers. Persons other than the patient or customer (or other authorized user) may be considered or alternatively referred to as an "unauthorized user". The unauthorized user may include unspecified persons or one or more person(s) that an authorized user specifically designates to be an unauthorized user. For example, the unauthorized user may be a child or other person known to the authorized user whom the authorized user does not want to access the medication.

Accordingly, in some aspects, the present devices, systems and methods may provide an efficient solution, as compared to current solutions, to alert an authorized user of a potential unauthorized access into a container of the authorized user. The container may be configured to send an alert or message to the authorized user when a device associated with the container detects an attempt to access the container itself (e.g., by moving the container) and/or access into the interior of the container (e.g., attempted or successful opening of container cap).

Referring to FIG. 1, in an aspect, a communication system 10 may be used to communicate an access and/or attempted access into container 30 to an authorized user 12. The container 30 may be a container, bottle, or some other device configured to store contents or substances in a closed environment. In this regard, the container 30 may include or have an associated cap or lid that is removably attached to the portion of the container 30 in which the contents or substances are stored. In an aspect, communication system 10 may include computing device 14, which may be configured to access or communicate with container alert system 22, by way of a wired and/or wireless communication channel 16, 20 (optionally via network 18), to thereby facilitate the storage of information (e.g., in a database associated with or part of the computing device 14) associated with the authorized user 12, which may then be associated with container 30. Alternatively, computing device 14 may communicate directly with container 30.

For example, an individual may access the container alert system 22 using computing device 14. It should be understood that computing device 14 may be, for example, a mobile device, a desktop computer, a laptop, a wireless device, or some other suitable mechanism for data input into container alert system 22. Optionally, the individual may provide authentication credentials (e.g., username and password, or biometric information) to access or otherwise log on to the container alert system 22 using a user interface of computing device 14. The individual may create a user profile, for example in a secure database associated with container alert system 22, to allow the individual to become an "authorized user" of a container and its contents. The user profile may optionally include data such as, but not limited to, a user identifier (e.g., personal identification (e.g., alphanumeric code and/or biometric data) which may be used for authenticating or verifying the user. In an aspect, the biometric data may include, but is not limited to, fingerprint data, iris data, retinal data, voice data, and facial data. The user profile may also include one or more modes of communication associated with the user. For example, the user profile may include authorized modes of communication used for transmitting an alert or message to the user based on an access of or attempted access into the container. For example, the user profile may include a phone number associated with a mobile device of the user and/or an e-mail address associated with the user. Further, the user profile may include additional data (such as user identifier and/or authorized modes of communication) associated with one or more other person(s) authorized by the user to access the container contents. The user identifier and/or authorized modes of communication associated with the user, and user identifier and/or authorized modes of communication associated with the one or more additional authorized person(s), may be the same or different, preferably different.

In an implementation wherein the container 30 contains pharmaceutical dosage forms, a pharmacy filling a prescription for a controlled drug substance or other drug that may be subject to abuse by an unauthorized user, obtains the user profile data for each authorized user from the secure database associated with container alert system 22. Container 30, either prior to or after being filled with the drug, is configured by the pharmacy with user profile data, by way of a wired and/or wireless communication channel 42, 44 (optionally via network 46). In such aspect, container 30 may include various components and/or subcomponents, which may be configured to store and verify identifying data associated with the at least one authorized user to prevent unauthorized access and/or alert an authorized user of an access of or attempted access into container 30. Container 30 may comprise a container bottle 37 and a container cap 38. The terms cap or lid may be used interchangeably as are the terms container and bottle. In some embodiments, the container 30 may include a motion detection device 33 configured to detect the position of the container or a change in the position of the container (e.g., tilt, motion, or other change or disturbance in position). For example, the motion detection device 33 may comprise an accelerometer, sensor, or level. The accelerometer, sensor, or level may be a mechanical device or an electromechanical device (e.g., micro-electro-mechanical or MEM devices). The motion detection device 33 may be located anywhere on the container 30, including the container bottle 37 or container cap 38, or it may be placed inside the container bottle.

In some implementations, alternatively or additionally, the container 30 may include an identification device 32 configured to receive an identifier of a person attempting access into the container. In some aspects, the identification device 32 may include, but is not limited to, one or more of a keypad or a biometric sensor such as a fingerprint sensor, a voice sensor, a retinal sensor, an iris sensor, and a facial recognition sensor. The identification device 32 may be located anywhere on the container 30, including the container bottle 37 or container cap 38, or it may be placed inside the container bottle.

In addition, the container 30 may include a processing device 34 in communication with the identification device 32 and/or motion detection device 33. In some aspects, the processing device 34 is configured to compare the identifier of the user attempting access to an identifier of the one or more authorized user(s). In some aspects, the processing device 34 is configured to determine if there is motion or movement (i.e., change in position from a stationary position) of the container 30, container cap 38, or container bottle 37. The processing device 34 may be located anywhere on the container 30, including the container bottle 37 or container cap 38, or it may be placed inside the container bottle. The processing device 34 may comprise one or more electronic or microelectronic devices configured to facilitate the processing of data and/or determination of an authorized access into the container 30. Further, the processing device may be in communication with a secure database (e.g. a storage device having non-volatile memory) configured to store authorized user identification data, and which may be securely accessed by the processing device. The secure database associated with the processing device may contain at least a portion of the user profile data from the secure database associated with container alert system 22.

The container 30 may include a container cap 38 including a locking mechanism configured to lock the container cap to the storage portion that stores the one or more objects. In one aspect, the locking mechanism may be in communication with the processing device 34 and may be configured to unlock only when the processing device 34 determines that the identifier of the user attempting access matches the identifier of the one or more authorized user(s). For example, the locking mechanism may be configured to unlock when input to the identification device 32 matches at least one identifier associated with the authorized user stored in the secured database in communication with the processing device 34. However, the container 30 may be configured to not unlock or remain locked when the processing device 34 determines that the identifier of the user attempting access does not match any identifier of the one or more authorized user(s).

In another aspect, the locking mechanism may be configured to unlock whether or not the processing device 34 determines that the identifier of the user attempting access matches the identifier of the one or more authorized user(s). Such an embodiment may be useful, for example, when an authorized user wants to grant temporary access into the container by an unauthorized user without disclosing or using an authorized user identifier.

Further, the container 30 may comprise a transmitter 36, in communication with the processing device 34, which, either itself or optionally in conjunction with a network 54, transmits an indication (e.g., alert or message) 52 to a remote device 56 associated with the authorized user 12 when the container 30 is moved from a stationary position. Alternatively or additionally, the transmitter 36 may be configured to transmit an indication 52 to a remote device 56 when the identifier of the user attempting access does not match the identifier of the authorized user. For example, the transmitter 36 may be configured to transmit an indication 52 wirelessly to the remote device 56 via a relay providing wireless service to the remote device. In such aspects, the transmitter 36 may wireless transmit an indication in the form a short message service (SMS) indication to a relay providing wireless service (e.g., base station) for routing to the remote device.

Optionally, the transmitter may alternatively or additionally transmit an indication to the container alert system 22, and data regarding the unauthorized access and/or attempted access may be stored in a secure database.

Each of the various components and/or subcomponents of the container 30 may communicate with one another via a bus. In other aspects, each of the aspects described herein with respect to the container 30 may also be arranged on any portion of the container 30 such that unauthorized access may be prevented and/or such access may be communicated to the authorized user.

In some implementations, the identification device, motion detection device, processing device, and transmitter, when present, are located on or in the container bottle 37. In some embodiments, the identification device, motion detection device, processing device, and transmitter, when present, are located on or in the container cap 38. In some embodiments, one or more of the identification device, motion detection device, processing device, and transmitter, when present, are located on or in the container cap 38, and one or more of the identification device, motion detection device, processing device, and transmitter, when present, are located on or in the container bottle 37.

The container 30, the container bottle 37, and/or the container cap 38 may be returned by the user upon completion of the medication and at least a portion of the container may be reused by the pharmacy.

In another aspect of FIG. 1, the container 30 may include a receiver to receive information from, for example, a database. The information may include identifier information associated with an authorized user of the container 30. In addition, the container 30 may include an opening trigger detection device configured to detect when the container cap 38 is at least partially removed from the container bottle 37. As described above, one or both of the receiver and the opening trigger detection device may be located or positioned on or in the container bottle 37 or located or positioned on or in the container cap 38. Moreover, the opening trigger detection device may be in communication with the transmitter 36 to signal or indicate to the remote device 56, to the container alert system 22, or to both, that the container cap 38 has been at least partially removed or detached from the container 30.

Figure 2:
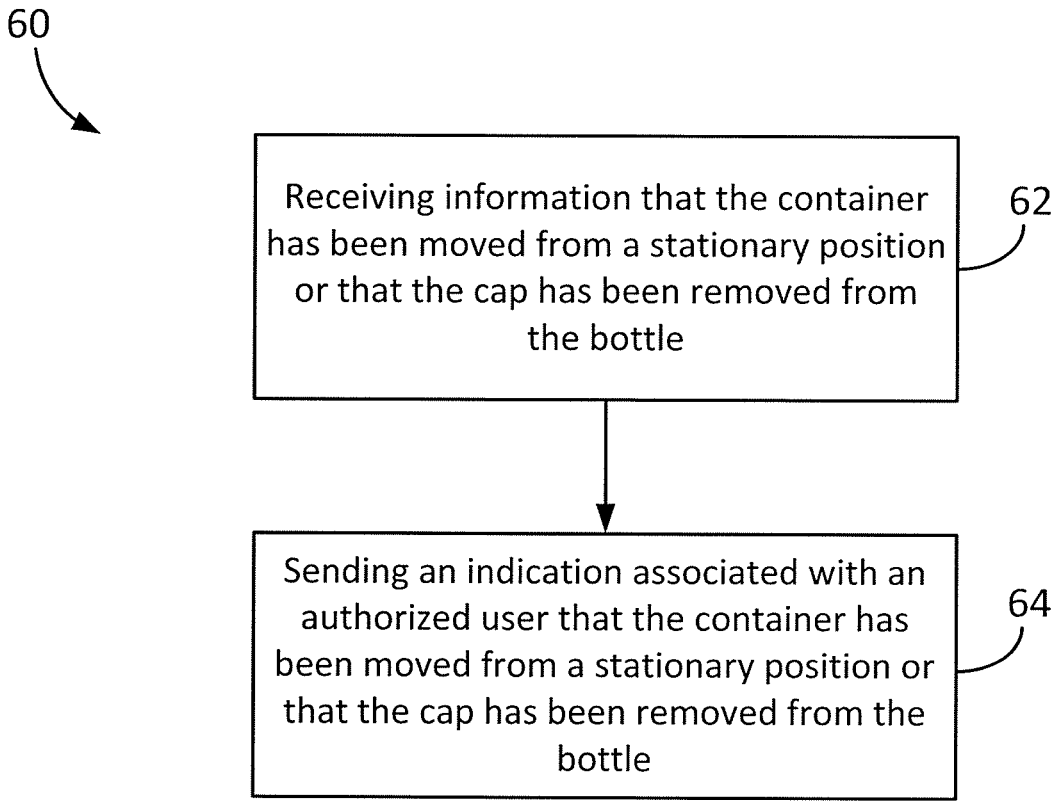
FIG. 2 is a flowchart of an aspect of an example method of detecting and alerting to unauthorized access into a container, in accordance with aspects of the present disclosure.
Figure 3:
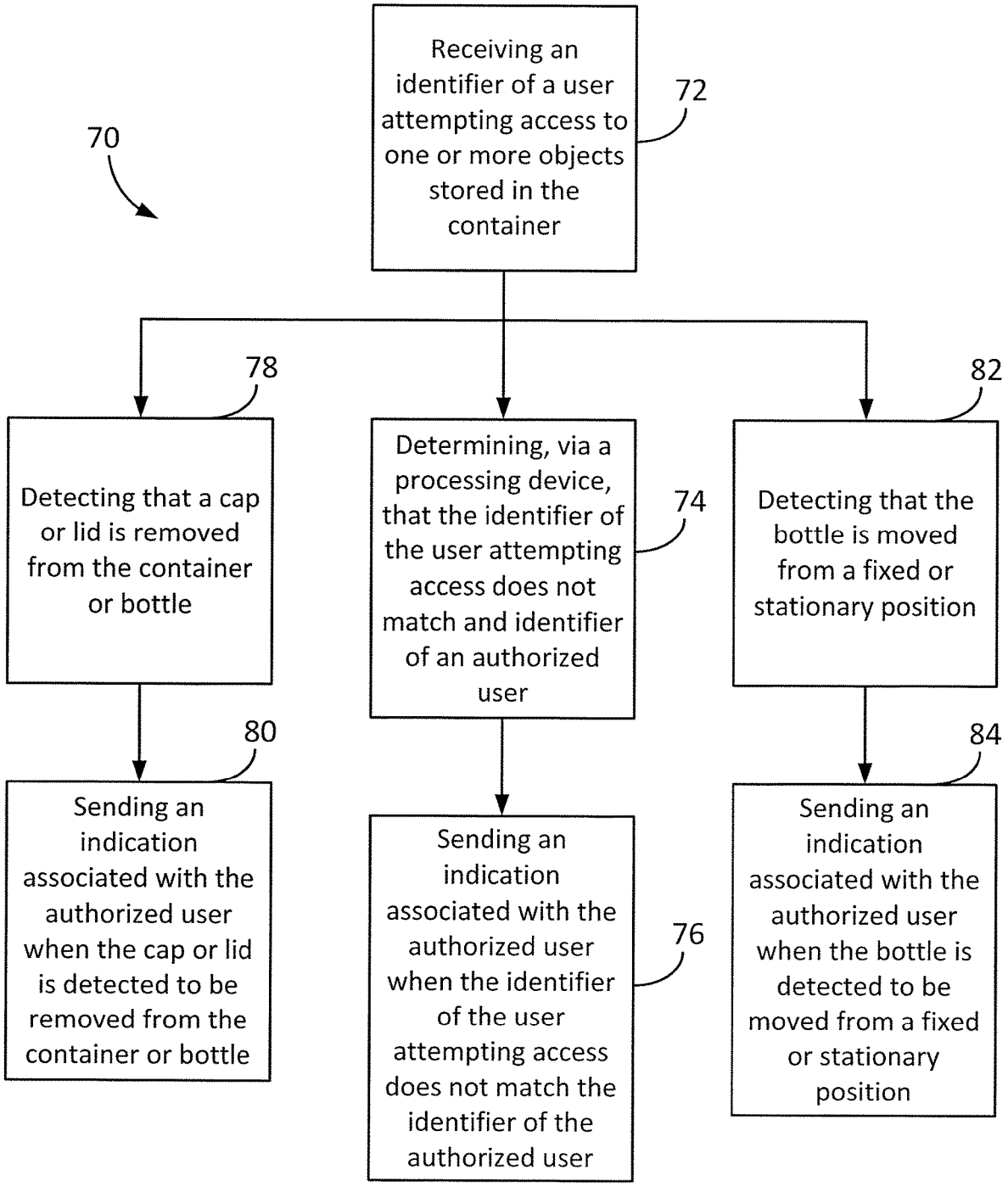
FIG. 3 is a flowchart of an aspect of an example method of detecting and alerting to unauthorized access into a container, in accordance with aspects of the present disclosure.

Referring to FIG. 2 and FIG. 3, in operational aspects, a container may be configured to perform method 60 and/or method 70. While, for purposes of simplicity of explanation, the methods are shown and described as a series of acts, it is to be understood and appreciated that the methods (and further methods related thereto) is/are not limited by the order of acts, as some acts may, in accordance with one or more aspects, occur in different orders and/or concurrently with other acts from that shown and described herein. For example, it is to be appreciated that a method could alternatively be represented as a series of interrelated states or events, such as in a state diagram. Moreover, not all illustrated acts may be required to implement a method in accordance with one or more features described herein.

Referring to FIG. 2, at block 62, method 60 may receive information that the container has been moved from a stationary position or that the cap has been removed from the bottle. For example, a motion detection device may determine that the container has been tilted, moved, displaced, or otherwise disturbed from a stationary position. In another example, an opening trigger detection device may determine that the cap or lid of the container has been at least partially removed.

Further, at block 64, method 60 may send an indication (e.g., via a network) to a remote device associated with the authorized user when the container has been moved from a stationary position or when the cap has been removed from the bottle. Additionally, the sending of the indication may include sending the indication wirelessly to the remote device via a relay providing wireless service to the remote device.

It should be understood that any one or more components of container 30 may be configured to execute one or more steps of method 60.

In another aspect of method 60, block 62 may also correspond to receiving a first indication that the container or bottle has been moved or displaced from a stationary position and receiving a second indication that a lid or cap is at least partially removed from the container or bottle. Moreover, block 64 may also correspond to transmitting a third indication to a remote device via a network, the third indication being transmitted to communicate to a user associated with the remote device that one or both of the first indication is received or the second indication is received.

Referring to FIG. 3, at block 72, method 70 may receive an identifier of a user attempting access to one or more objects stored in the container. For example, the container may scan, read or otherwise receive, via an identification device, an identifier of a user attempting access.

Further, at block 74, method 70 may determine, via a processing device, that the identifier of the user attempting access does not match an identifier of an authorized user. For example, processing device may compare the identifier received from the user to one or more identifiers associated with one or more authorized users.

At block 76, method 70 may send an indication to a remote device associated with the authorized user when the identifier of the user attempting access does not match the identifier of the authorized user. In other aspects, an indication may be sent to the remote device when the identifier of the user attempting access matches the identifier of the authorized user. Additionally, the sending of the indication may include sending the indication wirelessly to the remote device via a relay providing wireless service to the remote device.

In another aspect of method 70, at block 78, a detection or determination may be made that the cap or lid of the container or bottle has been at least partially removed. For example, an opening trigger detection device may make such detection or determination. At block 80, method 70 may send an indication to a remote device associated with the authorized user when the cap or lid is detected to be removed from the container or bottle.

In yet another aspect of method 70, at block 82, a detection or determination may be made that the container or bottle has been moved or displaced from a fixed or stationary position. For example, a motion detection device may make such detection or determination. At block 84, method 70 may send an indication to a remote device associated with the authorized user when the container or bottle is detected to be moved or displaced from a fixed or stationary position.

It should be understood that any one or more components of container 30 may be configured to execute one or more steps of method 70. It should also be understood that any one or more components of container 30 may be configured to execute one or more steps of both method 60 and method 70.

In another aspect of FIG. 3, one or more of the functions in blocks 72, 74, 76, 78, 80, 82, and 84 may correspond to receiving a first indication that the container or bottle has been moved or displaced from a stationary position, receiving a second indication that a lid or cap is at least partially removed from the container or bottle, receiving an identifier of a user attempting to access one or more substances stored in the container or bottle, determining, via processing device, whether the identifier of the user attempting to access the one or more substances stored in the container or bottle matches an identifier of an authorized user, and transmitting a third indication to a remote device via a network. The third indication being transmitted to communicate to a user associated with the remote device that one or more of the first indication is received, the second indication is received, or the identifier of the user attempting to access the one or more substances stored in the container or bottle is determined not to match the identifier of the authorized user.

Figure 4:
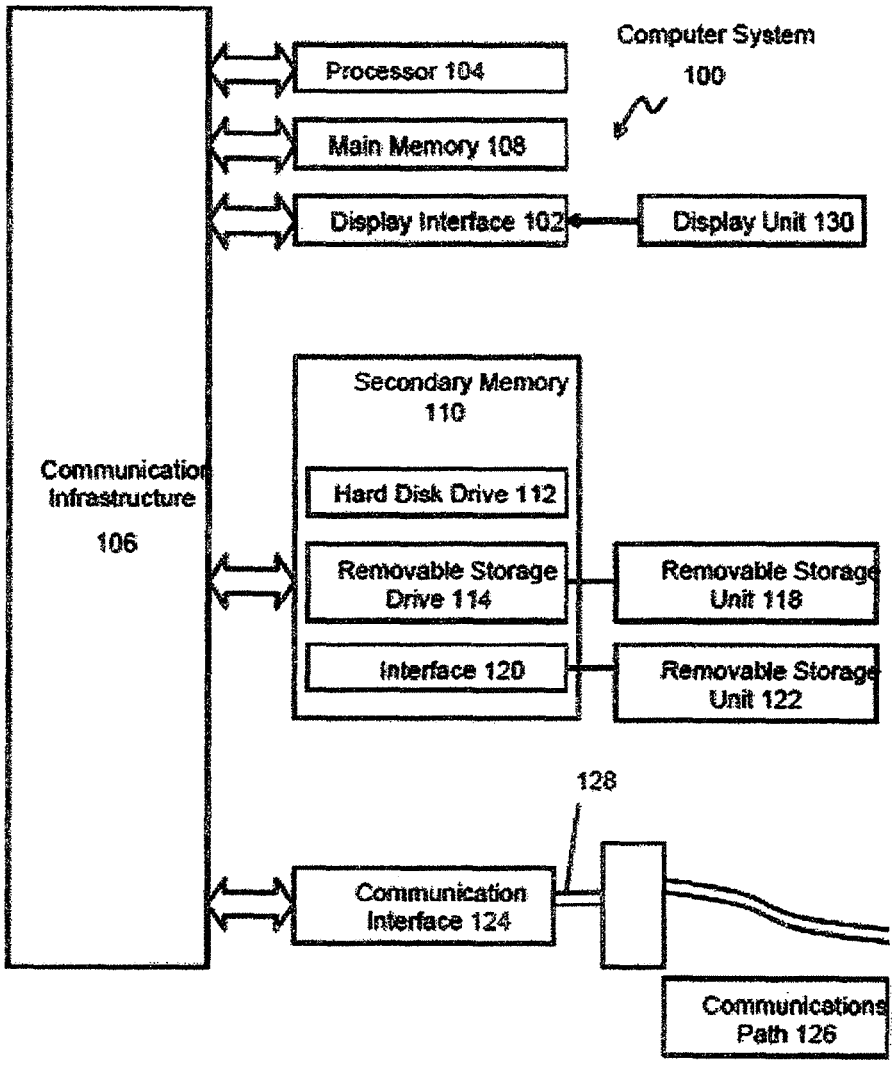
FIG. 4 is an example conceptual diagram illustrating an example computer system including an aspect of the present disclosure, e.g., according to FIGS. 1, 2, and 3.

The present aspects may be implemented using hardware, software, or a combination thereof and may be implemented in one or more computer systems or other processing systems. In an aspect of the present disclosure, features are directed toward one or more computer systems capable of carrying out the functionality described herein. An example of such a computer system 100 is shown in FIG. 4. It should be understood that one or more components and or subcomponents of the computer system 100 may be included in, the same as, in conjunction with, or similar to computing device 14, container alert system 22, and/or container 30. Moreover, it is to be understood that any of the aspects of methods 60 and 70 described above may be implemented in the container 30, the container bottle 37, or the container cap 38 by using one or more components and or subcomponents of the computer system 100. In addition, aspects associated with the functionality of the motion detection device, the identification device, the processing device, and the opening trigger detection device described above can be implemented in the container 30, the container bottle 37, or the container cap 38 by using one or more components and or subcomponents of the computer system 100.

Computer system 100 includes one or more processors, such as processor 104. The processor 104 is coupled to a communication infrastructure 106 (e.g., a communications bus, cross-over bar, or network). For example, the communication infrastructure may be located or installed locally or located at a cloud computing network/device. Various software aspects are described in terms of this example computer system. After reading this description, it will become apparent to a person skilled in the relevant art(s) how to implement aspects hereof using other computer systems and/or architectures.

Computer system 100 may include a display interface 102 that forwards graphics, text, and other data from the communication infrastructure 106 (or from a frame buffer not shown) for display on a display unit 130. Computer system 100 may include a main memory 108, preferably random access memory (RAM), and may also include a secondary memory 110. The secondary memory 110 may include, for example, a hard disk drive 112 and/or a removable storage drive 114, representing a floppy disk drive, a magnetic tape drive, an optical disk drive, etc. The removable storage drive 114 may read from and/or write to a removable storage unit 118 in a well-known manner. Removable storage unit 118, represents a floppy disk, magnetic tape, optical disk, etc., which may be read by and written to removable storage drive 114. As will be appreciated, the removable storage unit 118 may include a computer usable storage medium having stored therein computer software and/or data.

Alternative aspects of the present disclosure may include secondary memory 110 and may include other similar devices for allowing computer programs or other instructions to be loaded into computer system 100. Such devices may include, for example, a removable storage unit 122 and an interface 120. Examples of such may include a program cartridge and cartridge interface (such as that found in video game devices), a removable memory chip (such as an erasable programmable read only memory (EPROM), or programmable read only memory (PROM)) and associated socket, and other removable storage units 122 and interfaces 120, which allow software and data to be transferred from the removable storage unit 122 to computer system 100.

Computer system 100 may also include a communications interface 124. Communications interface 124 may allow software and data to be transferred among computer system 100 and external devices. Examples of communications interface 124 may include a modem, a network interface (such as an Ethernet card), a communications port, a Personal Computer Memory Card International Association (PCMCIA) slot and card, etc. Software and data transferred via communications interface 124 may be in the form of signals 128, which may be electronic, electromagnetic, optical or other signals capable of being received by communications interface 124. These signals 128 may be provided to communications interface 124 via a communications path (e.g., channel) 126. This path 126 may carry signals 128 and may be implemented using wire or cable, fiber optics, a telephone line, a cellular link, a radio frequency (RF) link and/or other communications channels. As used herein, the terms "computer program medium" and "computer usable medium" refer generally to media such as a removable storage drive 114, 118 and/or 122, a hard disk installed in hard disk drive 112, and/or signals 128. These computer program products may provide software to the computer system 100. Aspects of the present disclosure are directed to such computer program products.

Computer programs (also referred to as computer control logic) may be stored in main memory 108 and/or secondary memory 110. Computer programs may also be received via communications interface 124. Such computer programs, when executed, may enable the computer system 100 to perform the features in accordance with aspects of the present disclosure, as discussed herein. In particular, the computer programs, when executed, may enable the processor 110 to perform the features in accordance with aspects of the present disclosure. Accordingly, such computer programs may represent controllers of the computer system 100.

Where aspects of the present disclosure may be implemented using software, the software may be stored in a computer program product and loaded into computer system 100 using removable storage drive 114, hard drive 112, or communications interface 120. The control logic (software), when executed by the processor 104, may cause the processor 104 to perform the functions described herein. In another aspect of the present disclosure, the system may be implemented primarily in hardware using, for example, hardware components, such as application specific integrated circuits (ASICs). Implementation of the hardware state machine so as to perform the functions described herein will be apparent to persons skilled in the relevant art(s).

Figure 5:
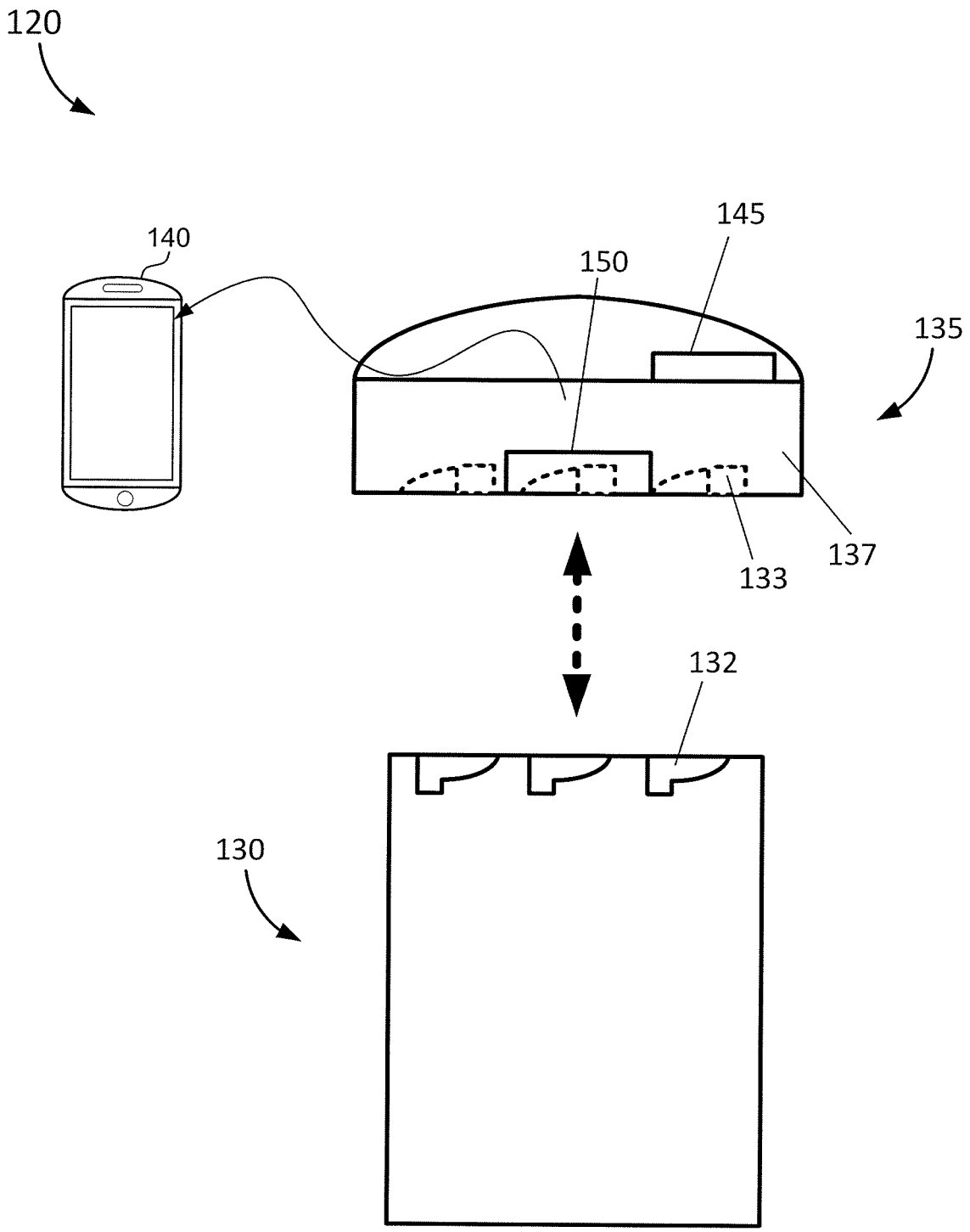
FIG. 5 is an example conceptual diagram illustrating an example Bottle and cap and its general functions including an aspect of the present disclosure, e.g., according to FIGS. 1, 2, 3 and 4.

Referring to FIG. 5, there is shown a container system 120 having a container bottle 130 and a container cap 135. The container bottle 130 may correspond to the container bottle 37 described above. In an aspect, the container bottle 130 is intended to remain the same for different implementations while the container cap 135 may be configured to match brand caps. For example, the cap closure nubs 132 in the container bottle 130 need not change. The container cap 135 may correspond to the container cap 38 described above. In this regard, the container cap 135 may include one or more of a transmitter, a receiver, a motion detection device, a processing device, an identification device, or an opening trigger detection device.

In the example shown in FIG. 5, the container cap 135 has a cap closure section 137 that includes multiple cap closure slots 133. The cap closure slots 133 are intended to match the cap closure nubs 132 in the container bottle 130. The cap closure section 137 may have in or on it a bottle leveling device 145 configure to detect when the bottle or container is no longer level. The bottle leveling device 145 may be a mechanical or electro-mechanical device and may be configured to transmit a signal or some other indication to the owner or authorized user when the bottle is detected to no longer been on a level surface. Such condition may be an indication that the bottle or container has been moved. In another aspect, the bottle leveling device 145 may instead use a transmitter in the container cap 135 to send or transmit the indication. In one example, a signal may be sent to a remote device 140 (e.g., mobile device) to indicate that the bottle or container is no longer on a level surface, where such a signal may be used to display a text message on the remote device 140.

In another aspect, the container cap 135 may include a device 150 (e.g., an opening trigger detection device) that detects when the container cap 135 has been removed, or at least partially removed, from the container bottle 130. In one example, the device 150 may transmit a signal to the remote device 140, which in turn displays a text message to the user that the container cap 135 has been removed. In another example, the signal is sent by a transmitter included in the container cap 135.

In yet another aspect of FIG. 5, the container cap 135 may be configured to send a signal to the remote device 140 indicating an area, location, or position of the container cap 135. In such a case, when the container cap 135 is attached or locked into the container bottle 130, the indication of the area, location, or position provided to the remote device 140 corresponds to that of the container system 120.

Although examples of the present aspects have now been discussed in accordance with the above advantages, it will be appreciated by one of ordinary skill in the art that these examples are merely illustrative and that numerous variations and/or modifications may be made without departing from the spirit or scope hereof.

What is claimed:

1. A cap configured to be removably attached to a container or a bottle; wherein the cap comprises:

(a) an opening trigger detection device configured to detect when the cap is removed from the container or the bottle;

(b) a leveling device configured to detect movement or displacement of the cap when attached to the container or the bottle; and (c) a transmitter in communication with the opening trigger detection device and the leveling device;

wherein the transmitter is configured to transmit an alert to one or both of a remote device or an alert system in response to the opening trigger detection device detecting the cap being at least partially removed from the container or the bottle; and/or wherein the transmitter is configured to transmit an alert to one or both of a remote device or an alert system in response to the detecting a movement or displacement of the cap when attached to the container or the bottle.

2. The cap according to claim 1, further comprising an illumination device;

wherein the illumination device is configured to generate a visual indication in response to the opening trigger detection device detecting the cap being at least partially removed from the container or the bottle.

3. The cap according to claim 1, wherein the remote device includes a mobile device.

4. The cap according to claim 1, wherein the transmitter is configured to wirelessly transmit the alert via a network using a relay providing wireless service to the network.

* * * * *